United States Patent [19]

Moral

[11] Patent Number: 4,991,750

[45] Date of Patent: Feb. 12, 1991

[54] MOUNTING FOR EXTENSION TUBE

[75] Inventor: Leonardo D. Moral, Streamwood, Ill.

[73] Assignee: Pittway Corp., Cary, Ill.

[21] Appl. No.: 281,462

[22] Filed: Dec. 8, 1988

[51] Int. Cl.[5] ..... B65D 83/00

[52] U.S. Cl. ..... 222/402.24; 222/567; 239/337

[58] Field of Search ..... 222/567, 570, 566, 402.24, 222/394, 402.1; 239/337, 436

[56] References Cited

U.S. PATENT DOCUMENTS

| | | | |
|---|---|---|---|
| 2,025,067 | 12/1935 | Miller | 222/567 |
| 2,908,446 | 10/1959 | Strouse | 222/394 |
| 3,346,195 | 10/1967 | Groth | 222/394 |
| 3,450,314 | 6/1969 | Gross | 222/402.24 |
| 3,472,457 | 10/1969 | McAvoy | 222/402.1 |
| 4,401,272 | 8/1983 | Merton et al. | 222/402.24 |

FOREIGN PATENT DOCUMENTS

| | | | |
|---|---|---|---|
| 1507805 | 12/1967 | France | 239/337 |

*Primary Examiner*—H. Grant Skaggs
*Assistant Examiner*—Kenneth Noland
*Attorney, Agent, or Firm*—Frijouf, Rust & Pyle

[57] ABSTRACT

An improved mounting for an extension tube is disclosed for use with a fluid sprinkling apparatus. The fluid sprinkling apparatus has an input orifice communicating with a liquid internal a pressurized container for spraying the liquid through the extension tube. An actuator controls the flow of the liquid from the input orifice to a terminal orifice. A bore is defined in the fluid sprinkling apparatus extending from an outer wall and terminating in a inner wall. The terminal orifice is disposed within the inner wall and axially aligned with the bore. The bore has a plurality of shoulders spaced along the bore from the outer wall to the inner wall for respectively defining a plurality of bore portions. The plurality of bore portions have progressively decreasing diameters from the outer wall to the inner wall for enabling the extension tube to be inserted into the bore and be frictionally retained by at least one of the bore portions.

18 Claims, 3 Drawing Sheets

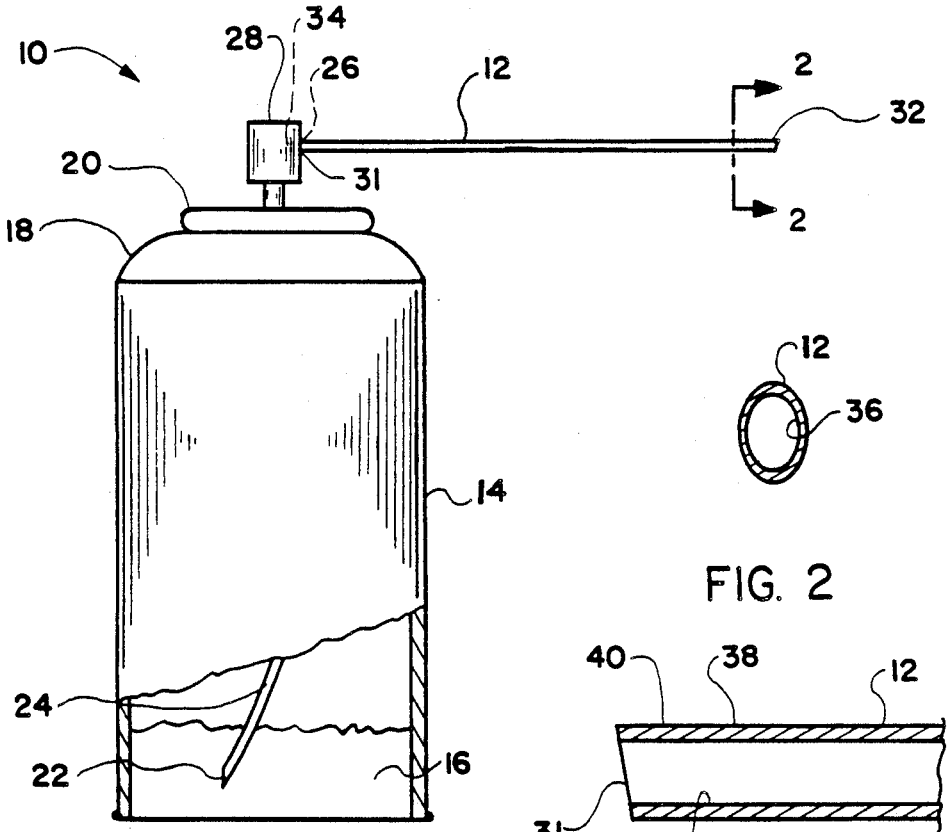
FIG. 1
FIG. 2
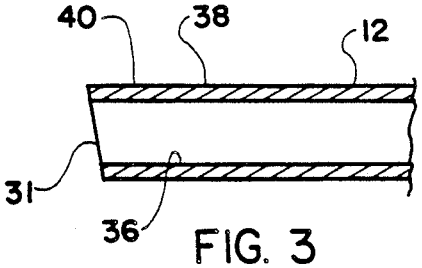
FIG. 3
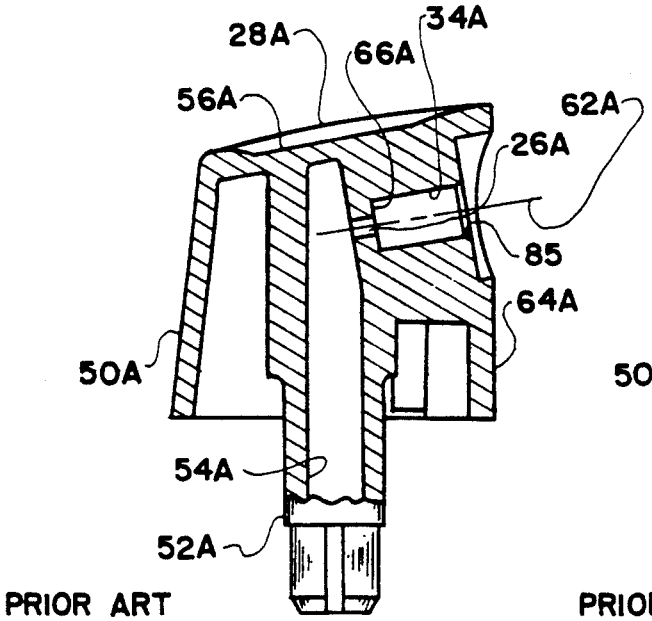
FIG. 4
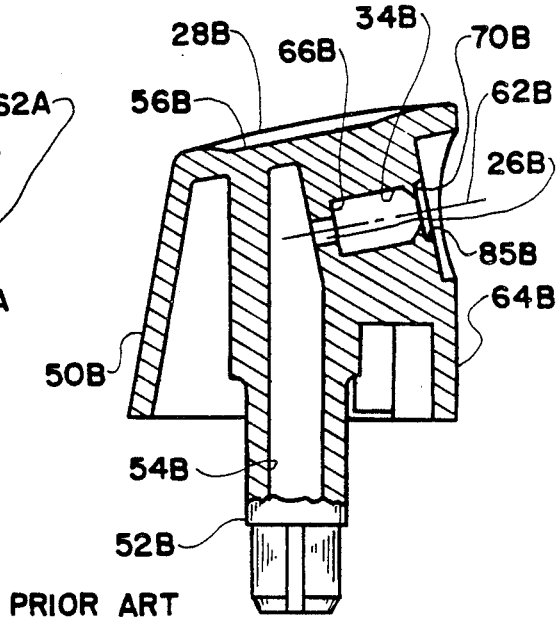
FIG. 5

MOUNTING FOR EXTENSION TUBE

BACKGROUND OF THE INVENTION

1. Field of the Invention

This invention relates to fluid sprinkling and more particularly to a fluid sprinkling apparatus incorporating an extension tube for directing the fluid after being expelled from a terminal orifice. More specifically, the invention relates to an improved mounting for an extension tube in a fluid sprinkling apparatus.

2. Information Disclosure Statement

Various types of fluid sprinkling devices have been known to the prior art for dispensing liquid materials. In general, a fluid sprinkling device has a fluid sprinkling head with an input orifice and a terminal orifice. The fluid sprinkling head is secured to a container with the input orifice communicating with the liquid internal the container. An actuator controls the flow of a liquid from the input orifice to the terminal orifice. The container is pressurized to force the liquid within the container into the input orifice to be expelled from the terminal orifice. Such fluid sprinkling devices include aerosol dispensing devices wherein the container is pressurized by an aerosol propellant as well as hand operated pumps wherein the container is pressurized by the pump.

Some fluid sprinkling devices incorporate specialized terminal orifices for providing different spray patterns and different spray characteristics. Other fluid sprinkling devices incorporate an auxiliary component for cooperating with the terminal orifice for providing a different spray pattern or different spray characteristic. One specialized auxiliary component for use with the terminal orifice is commonly known as an extension tube. An extension tube comprises a flexible tubing adapted to be frictionally retained within a bore of the fluid sprinkling head with the extension tube totally encompassing the terminal orifice. The extension tube is used to direct the liquid expelled from the terminal orifice into a confined area. The lubrication of a hinge or the direction of an insecticide into a building crevasse are two examples of the use of an extension tube.

Although extension tubes have been widely used in the prior art, certain problems exist in the use of the extension tubes with fluid sprinkling heads. In many cases, a variation in the tolerances of the extension tube and/or the bore of the fluid sprinkling head causes the extension tube to be insufficiently retained within the fluid sprinkling head. Under this condition, the extension tube may be release from the fluid sprinkling head during the use of the fluid sprinkling apparatus. The release of the extension tube from the fluid sprinkling head is commonly referred to as "blow out". In other cases, a variation in the tolerances of the extension tube and/or the bore of the fluid sprinkling head causes leaks to occur between the extension tube and the fluid sprinkling head. Leaks occurring between the extension tube and the bore of the fluid sprinkling head are commonly referred to as "blow by". In order to overcome these difficulties, the prior art attempted to increase the tightness of fit between the extension tube and the bore of the fluid sprinkling head. Unfortunately, this increase in the tightness of fit between the extension tube and the bore of the fluid sprinkling head made the insertion of the extension tube into the bore of the fluid sprinkling head more difficult for the consumer. These efforts proved to be unsatisfactory for a consumer product.

Others in the prior art incorporated an annular projection within the bore of the fluid sprinkling head in an effort to secure the extension tube within the bore. The annular projection within the bore of the fluid sprinkling head proved to be satisfactory in retaining the extension tube within the bore but did not prevent leaks from occurring between the extension tube and the bore.

Therefore, it is an object of the present invention to provide an improved mounting for an extension tube which overcomes the problems experienced by the prior art during the use of the extension tube with a fluid sprinkling head.

Another object of this invention is to provide an improved mounting for an extension tube which accommodates for a variation in the tolerances of the extension tube and/or the bore of the fluid sprinkling head.

Another object of this invention is to provide an improved mounting for an extension tube wherein the extension tube is sufficiently retained within the bore of the fluid sprinkling head to prevent the release of the extension tube from the fluid sprinkling head during the use of the fluid sprinkling apparatus.

Another object of this invention is to provide an improved mounting for an extension tube wherein the extension tube is sufficiently sealed to the bore of the fluid sprinkling head to prevent leaks from occurring between the extension tube and the fluid sprinkling head.

Another object of this invention is to provide an improved mounting for an extension tube which accommodates for a variation in the tolerances of the extension tube and/or the bore of the fluid sprinkling head without making the insertion of the extension tube into the bore of the fluid sprinkling head more difficult for the consumer.

Another object of this invention is to provide an improved mounting for an extension tube which overcomes the problems experienced by the prior art during the the use of the extension tube with a fluid sprinkling head without any additional cost in the manufacture of the fluid sprinkling apparatus and without any additional cost in the manufacture of the extension tube.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with the specific embodiment shown in the attached drawings. For the purpose of summarizing the invention, the invention relates to an improved mounting for an extension tube within a fluid sprinkling apparatus for spraying a liquid from a pressurized container through the extension tube. The fluid sprinkling apparatus has an input orifice communicating with the liquid internal the container. An actuator means controls the flow of the liquid from the input orifice to a terminal orifice.

The invention comprises a bore defined in the fluid sprinkling apparatus extending from an outer wall of the fluid sprinkling apparatus and terminating in an inner wall in the fluid sprinkling apparatus. The terminal orifice is disposed within the inner wall of the bore. The bore has a plurality of shoulders spaced along the bore from the outer wall to the inner wall for respectively defining a plurality of bore portions. The plurality of bore portions have progressively decreasing diameters from the outer wall to the inner wall for enabling the extension tube to be inserted into the bore and be frictionally retained by at least one of the bore portions. The progressively decreasing diameters enabling the extension tube to be frictionally retained irrespective of manufacturing tolerances of the bore and the outer diameter of the extension tube. The improved mounting of the present invention is suitable for use with aerosol dispensing devices as well as hand operated pumps.

In a more specific embodiment of the invention, a first of the bore portions located adjacent the outer wall is greater in diameter than the nominal outer diameter of the extension tube for enabling insertion of an end of the extension tube into the first of the bore portions of the bore. A chamfer is interposed between the outer wall and the first of the bore portions for further facilitating insertion of the extension tube into the first of the bore portions. The bore portion located adjacent the inner wall is less in diameter than the nominal outer diameter of the extension tube. The extension tube is constructed of a flexible plastic material with an internal channel defined within the extension tube for enabling the liquid from the terminal orifice to enter a proximal end of the extension tube and to be expelled from a distal end of the extension tube.

In one embodiment of the invention, the invention is incorporated into an improved aerosol button of an aerosol spraying apparatus for spraying a liquid from an aerosol container through an extension tube. The invention comprises an aerosol valve assembly including a dip tube defining an input orifice. The aerosol valve assembly is secured to the container with the input orifice communicating with the liquid internal the container. The aerosol valve assembly further comprises a button actuator having a terminal orifice for controlling the flow of the liquid from the input orifice to the terminal orifice. A cylindrical bore is defined within the aerosol button to extend along a cylindrical axis from an outer wall of the aerosol button to an inner wall. The terminal orifice is disposed within the inner wall and is positioned along the cylindrical axis of the cylindrical bore.

The cylindrical bore has a first shoulder defining a first bore portion with a chamfer interposed between the outer wall and the first bore portion. The chamfer facilitates insertion of the extension tube into the first bore portion. The cylindrical bore has a second shoulder defining a second bore portion extending between the first shoulder and the second shoulder. A third bore portion is defined between the second shoulder and the inner wall. The first bore portion has a first inner diameter which is less than the maximum outer diameter of the extension tube. The second bore portion has a second inner diameter which is less than the first inner diameter of the first bore portion whereas the third bore portion has a third inner diameter which is less than the second inner diameter of the second bore portion. The first, second and third inner diameter enable the extension tube to be inserted into the cylindrical bore of the fluid sprinkling head and to be frictionally retained by at least one of the bore portions irrespective of manufacturing tolerances of the bore of the fluid sprinkling head and irrespective of manufacturing tolerances of the outer diameter of the extension tube.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which:

FIG. 1 is a side elevational view of a fluid sprinkling apparatus utilizing an extension tube;

FIG. 2 is an enlarged sectional view along line 2—2 of FIG. 1;

FIG. 3 is an enlarged side sectional view of a proximal end of the extension tube of FIG. 1;

FIG. 4 is an enlarged side sectional view of one prior art spray button suitable for use with the extension tube of FIG. 1;

FIG. 5 is an enlarged side sectional view of another prior art spray button suitable for use with the extension tube of FIG. 1;

Similar reference characters refer to similar parts throughout the several Figures of the drawings.

DETAILED DISCUSSION

Figure 6:
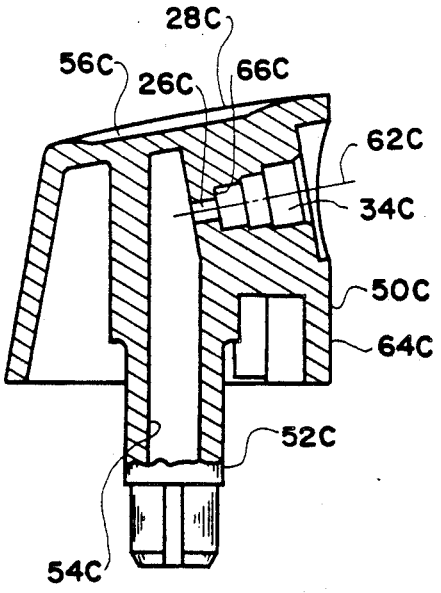
FIG. 6 is an enlarged side sectional view of an improved spray button incorporating the present invention suitable for use with the extension tube of FIG. 1.
Figure 7:
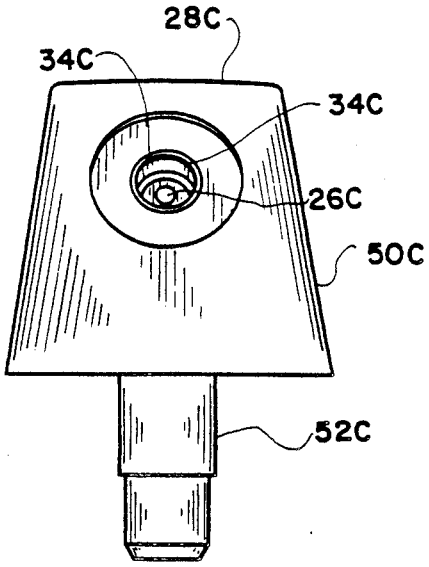
FIG. 7 is a front view of the improved spray button shown in FIG. 6.
Figure 8:
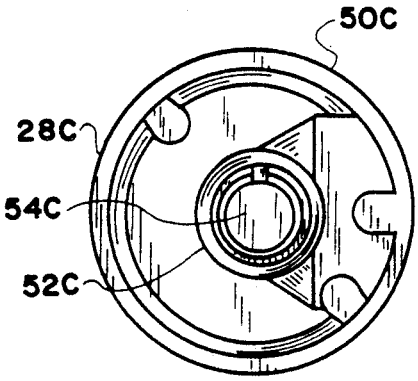
FIG. 8 is a bottom view of the improved spray button shown in FIG. 6.
Figure 9:
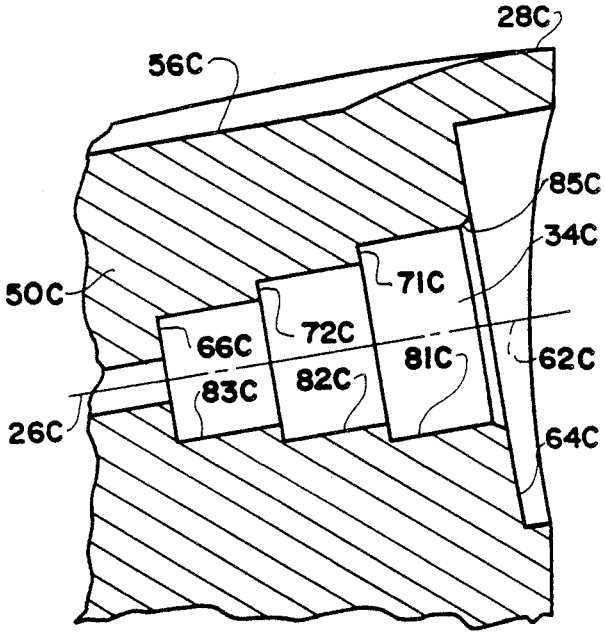
FIG. 9 is an enlarged side sectional view of a portion of the improved spray button of FIG. 6 illustrating the improved bore of the present invention.

FIG. 1 is a side elevational view of a fluid sprinkling apparatus 10 utilizing an extension tube 12. The fluid sprinkling apparatus 10 is shown as a conventional aerosol device but it should be understood that the present invention is equally applicable for use with a pump or the like. The fluid sprinkling apparatus 10 comprises a container 14 for containing a liquid 16 under pressure. A dome 18 secured to the container 14 for supporting a mounting cup 20 in a conventional manner. The mounting cup 20 retains an actuator such as an aerosol valve (not shown) for controlling the flow of the liquid 16 from an input orifice 22 in dip tube 24 to a terminal orifice 26 disposed within an aerosol button 28. The structure and use of an aerosol valve should be well known to those skilled in the art and such will not be explained herein.

The extension tube 12 comprises a proximal end 31 and a distal end 32. The proximal end 31 of the extension tube 12 is received within a bore 34 defined in the aerosol button 28 to encompass the terminal orifice 26. The proximal end 31 of the extension tube 12 receives the liquid 16 from the terminal orifice 26 and directs the liquid 16 from the distal end 32 into a narrow spray pattern for spraying into a confined area.

FIG. 2 is an enlarged sectional view along line 2—2 of FIG. 1 showing an internal channel 36 and an outer diameter 38 of extension tube 12. FIG. 3 is an enlarged side sectional view of the proximal end 31 of the extension tube 12. The outer diameter 38 of the proximal end 31 of the extension tube 12 is adapted to be received within bore 34. Preferably, the extension tube 12 comprises a flexible tubing enabling the extension tube 12 to be compressed when the extension tube 12 is inserted within bore 34. The flexible extension tube 12 also enables the extension tube 12 to be bent in order to direct liquid 16 from the distal end 32 of the extension tube 12 into a confined area. The outer diameter 38 of the extension tube 12 in many cases is not circular but may be oval as shown in FIG. 2. In addition, the proximal end 31 of the extension tube 12 in many cases is not cut perpendicular to the sidewall 40 of the extension tube 12 as shown in FIG. 3. The oval outer diameter 38 as well as the non-perpendicular proximal end 31 of the extension tube 12 have been exaggerated in FIGS. 2 and 3 for illustrative purposes. However, oval outer diameter 38 and the non-perpendicular proximal end 31 contribute to the difficulty in retaining the proximal end 31 of the within the bore 34 as well as contributing to leaks occuring between the extension tube 12 and the bore 34 as was experienced by the prior art.

FIG. 4 is an enlarged side sectional view of one prior art spray button 28A suitable for use with the extension tube of FIG. 1. The spray button 28A comprises a button body 50A with an integral stem 52A having a stem orifice 54A communicating with the terminal orifice 26A. The integral stem 52A is adapted to engage the aerosol valve (not shown) internal the container 14 for actuating the aerosol valve upon depression of the spray button 28A. A finger receiving portion 56A on the spray button 28A enables an operator to depress the spray button 28A for actuating the aerosol valve to control the flow of the liquid from the input orifice 22 to the terminal orifice 26A.

The spray button 28A includes a cylindrical bore 34A defined in the spray button 28A extending along a cylindrical axis 62A from an outer wall 64A to an inner wall 66A. The terminal orifice 26A is disposed within the inner wall 66A and is positioned along said cylindrical axis 62A of the cylindrical bore 34A. The cylindrical bore 34A has an inner diameter which is slightly less than the outer diameter of the proximal end 31 of the extension tube 12 to form an interference fit therebetween. When the proximal end 12 is inserted into the cylindrical bore 34A, the proximal end 12 is radially inwardly compressed to enable the proximal end 31 to be frictionally retained by the cylindrical bore 34A.

In many cases, the extension tube 12 was insufficiently retained by the cylindrical bore 34A causing the extension tube 12 to be release or "blown out" from the cylindrical bore 34A during the use of the fluid sprinkling apparatus 10. In other cases, leaks or "blow by" occured between the interference fit between the extension tube 12 and the cylindrical bore 34A. The problems of "blown out" and/or "blow by" generally occured when the outer diameter 38 of the proximal end 31 of the extension tube 12 was not circular as shown in FIG. 2 or when the proximal end 31 of the extension tube 12 was not cut perpendicular to the sidewall 40 of the extension tube 12 as shown in FIG. 3. Attempts to make the plurality of projections 70B larger in size resulted in difficulty inserting the extension tube 12 into the cylindrical bore 34B for the consumer. Furthermore, the plurality of projections 70B were difficult to mold into the spray button 28B.

FIG. 5 is an enlarged side sectional view of another prior art spray button 28B suitable for use with the extension tube 12 of FIG. 1. The spray button 28B illustrates one attempt of the prior art to solve the difficulties experienced with the spray button 28A shown in FIG. 4. The spray button 28B comprises a button body 50B with an integral stem 52B having a stem orifice 54B communicating with the terminal orifice 26B. The integral stem 52B actuates the aerosol valve upon depression of a finger receiving portion 56B to control the flow of the liquid from the input orifice 22 to the terminal orifice 26B.

A cylindrical bore 34B extends along a cylindrical axis 62B from an outer wall 64B of the spray button 28B to an inner wall 66B. The terminal orifice 26B is disposed within the inner wall 66B and is positioned along said cylindrical axis 62B. The cylindrical bore 34B has an inner diameter which is slightly less than the nominal outer diameter of the proximal end 31 of the extension tube 12.

In this prior art spray button 28B, a plurality of projection 70B are located within cylindrical bore 34B adjacent the outer wall 64B. The annular projection 70B has an inner diameter which is slightly less than the outer diameter of the proximal end 31 of the extension tube 12. The annular projection 70B attempted to improve the retention of the extension tube 12 within the cylindrical bore 34B. Although the spray button 28B incorporating the annular projection 70B within was superior to the spray button 28A shown in FIG. 4, the spray button 28B shown in FIG. 5 still exhibited the undesired characteristics of "blown out" and/or "blow by" when the outer diameter 38 of the proximal end 31 was not circular or when the proximal end 31 was not cut perpendicular to the sidewall 40 of the extension tube 12.

FIGS. 6–9 illustrate enlarged views of a spray button 28A incorporating the present invention and which is suitable for use with the extension tube 12 of FIG. 1. The spray button 28C comprises a button body 50C with an integral stem 52C having a stem orifice 54C communicating with the terminal orifice 26C. The integral stem 52C is adapted to engage an aerosol valve (not shown) internal the container 14 for actuating the aerosol valve upon depression of the spray button 28C. The spray button 28C is shown in this embodiment with an integral stem 52C but any button may be suitable for use with the present invention. The spray button 28C includes a finger receiving portion 56C for enabling an operator to depress the spray button 28C for actuating the aerosol valve to control the flow of the liquid from the input orifice 22 to the terminal orifice 26C.

The spray button 28C includes a cylindrical bore 34C extending along a cylindrical axis 62C from an outer wall 64C to an inner wall 66C. The terminal orifice 26C is disposed within the inner wall 66C and is positioned along said cylindrical axis 62C. The cylindrical bore 34C has a first and a second shoulder 71C and 72C defining a first, a second and a third bore portion 81C, 82C and 83C respectively. A chamfer 85C is interposed between the outer wall 64C and the first bore portion 81C for facilitating insertion of the extension tube 12 into the first bore portion 81C. The second bore portion 82C extends between the first shoulder 71C and the second shoulder 72C. The third bore portion 83C extends between the second shoulder 72C and the inner wall 66C.

Preferably, the first bore portion 81C has a first inner diameter which is less than the maximum outer diameter of the extension tube 12. The second bore portion 82C has a second inner diameter which is less than the first inner diameter of the first bore portion 81C whereas the third bore portion 83C has a third inner diameter which is less than the second inner diameter of the second bore portion 82C. The first, second and third bore portions 81C, 82C and 83C have the following inner diameters. The first bore portion 81C has a first inner diameter which is less than the largest manufactured outer diameter of the extension tube 12 including manufacturing tolerances. The second bore portion 82C has a second inner diameter which is less than the nominal outer diameter of the extension tube 12. The third bore portion 83C has a third inner diameter which is less than the smallest manufactured outer diameter of the extension tube 12 including manufacturing tolerances. The selections of the first, second and third inner diameters enables the extension tube 12 to be inserted into the cylindrical bore 34C of the spray button 28C and be frictionally retained by at at least one of the first, second or third bore portions 81C, 82C, 83C irrespective of manufacturing tolerances of the actual outer diameter of the extension tube 12.

Figure 10:
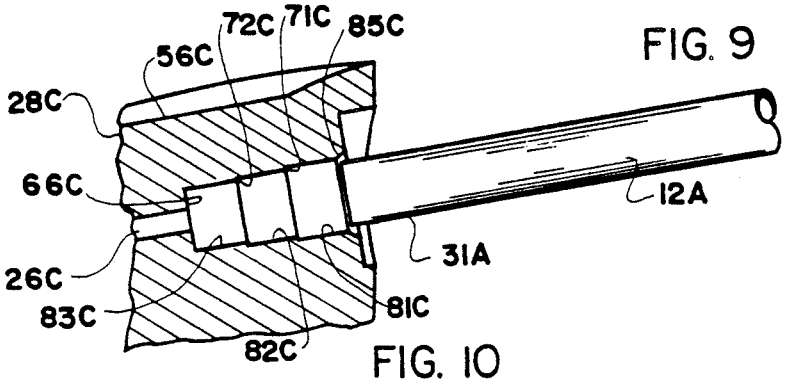
FIG. 10 is an enlarged side sectional view of a portion of the improved spray button of FIG. 6 illustrating the insertion of an extension tube into the improved bore of the present invention.

FIG. 10 illustrates the proximal end 31A of an the extension tube 12A being inserted into bore 34C. The proximal end 31A of the extension tube 12A is representative of an extension tube having a maximum outer diameter including manufacturing tolerances of the extension tube. The chamfer 85C facilitates the insertion of the proximal end 31A of the maximum outer diameter extension tube 12A into the first bore portion 81C.

Figure 11:
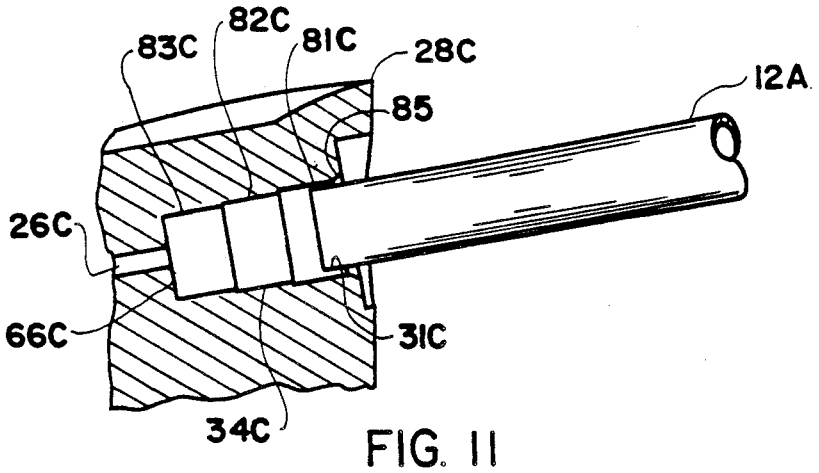
FIG. 11 is an enlarged side sectional view of a portion of the improved spray button of FIG. 6 illustrating the insertion of the extension tube into a first bore portion of the present invention.

FIG. 11 illustrates the continued insertion of the proximal end 31A of the extension tube 12A into bore 34C. As the insertion process continues, the proximal end 12A of the maximum outer diameter extension tube 12A is compressed radially inwardly to form an interference fit with the first bore portion 81C. The interference fit between the proximal end 31A of the maximum outer diameter extension tube 12A and the first bore portion 81C is selected to provide proper retention of the extension tube 12A within the first bore portion 81C.

Figure 12:
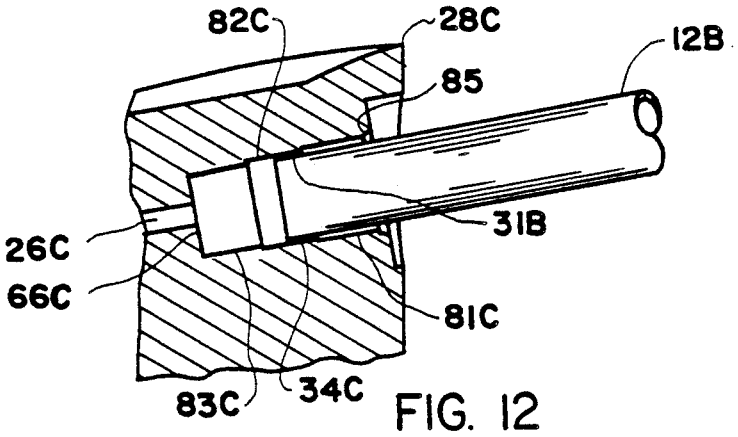
FIG. 12 is an enlarged side sectional view of a portion of the improved spray button of FIG. 6 illustrating the insertion of the extension tube into a second bore portion of the present invention.

FIG. 12 illustrates the proximal end 31B of an extension tube 12B being inserted to bore 34C. The proximal end 31B of the extension tube 12B is representative of an extension tube having a nominal outer diameter. The chamfer 85C as well as the larger outer diameter of the first bore portion 81C facilitate the insertion of the proximal end 31B of the nominal outer diameter extension tube 12B into the second bore portion 82C. As the insertion process continues, the proximal end 31B of the nominal outer diameter extension tube 12B undergoes further radial inward compression to form an interference fit with the second bore portion 82C. The interference fit between the proximal end 31B of the nominal outer diameter extension tube 12B and the second bore portion 82C is selected to provide proper retention of the extension tube 12B within the second bore portion 82C.

Figure 13:
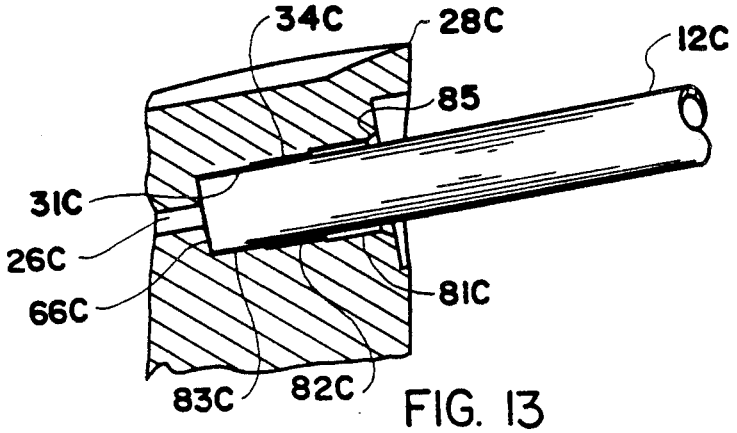
FIG. 13 is an enlarged side sectional view of a portion of the improved spray button of FIG. 6 illustrating the insertion of the extension tube into a third bore portion of the present invention.

FIG. 13 illustrates the proximal end 31C of an extension tube 12C being inserted to bore 34C. The proximal end 31C of the extension tube 12C is representative of an extension tube having a minimum outer diameter including manufacturing tolerances of the extension tube. The chamfer 85C as well as the larger outer diameters of the first bore portion 81C and the second bore portion 82C facilitate the insertion of the proximal end 31C of the minimum outer diameter extension tube 12C into the third bore portion 83C. As the insertion process continues, the proximal end 31C of the minimum outer diameter extension tube 12C is again compressed radially inwardly to form an interference fit with the third bore portion 83C. The interference fit between the proximal end 31C of the minimum outer diameter extension tube 12C and the third bore portion 83C is selected to provide proper retention of the extension tube 12C within the third bore portion 83C.

The present invention comtemplates the selection of the inner diameter of the first bore portion 81C to form an interference fit with the maximum outer diameter including manufacturing tolerances of the extension tube. The inner diameter of the second bore portion 82C is selected to form an interference fit with the nominal outer diameter of the extension tube. Finally, the inner diameter of the third bore portion 83C is selected to form an interference fit with the minimum outer diameter of the extension tube including manufacturing tolerances of the extension tube. It should be appreciated that although three bore portions have been shown in the preferred embodiment, the present invention contemplates the use of either more bore portions or less bore portion. The number of bore portions required for the successful practice of the present invention is in part determined by the manufacturing tolerances of the extension tube.

The use of three bore portions as set forth herein enables the proximal end of the extension tube to be properly retained by at least one of the bore portions irrespective of the outer diameter of the extension tube. It should be clear to those skilled in the art that a consumer will find it difficult to insert the proximal end the extension tube having a maximum outer diameter including manufacturing tolerances into the bores 34A and 34B of the prior art aerosol buttons 28A and 28B shown in FIGS. 4 and 5. It should be clear also to those skilled in the art that the proximal end the extension tube having a minimum outer diameter including manufacturing tolerances will not be properly retained within the bores 34A and 34B of the prior art aerosol buttons 28A and 28B shown in FIGS. 4 and 5.

The retention force in the interference fit between the extension tube and a bore is given by the formula (1);

$$F=\mu N \tag{1}$$

where F is the retention force, $\mu$ is the coefficient of friction and N is the normal force. The normal force N is determined by the interference fit between the extension tube and the bore. Since at least one of the the extension tube or the bore is stressed by the interference fit, an interface pressure P is created by the interference fit. The normal force N is given equation (2);

$$N=AP \tag{2}$$

where A is the contact area and P is the interface pressure. The interface pressure P is given by equation (3)

$$P = \frac{d}{b\left[\frac{1}{E_b}\left(\frac{c^2+b^2}{c^2-b^2}+V_b\right)+\frac{1}{E_t}\left(\frac{b^2+a^2}{b^2-a^2}-V_t\right)\right]} \tag{3}$$

where $d=r_t-r_b$ and is the radial interference between the radius $r_t$ of the extension tube and the radius $r_b$ of the bore, a is the radius of the internal channel of the extension tube, b is of the average of the radius $r_t$ of the extension tube and the radius $r_b$ of the bore, c is the radius of the bore, $E_b$ is the elastic modulus of the bore, $E_t$ is the elastic modulus of the extension tube, $v_b$ is the Poisson's ratio of the bore and $v_t$ is the Poisson's ratio of the extension tube.

It should be clear to one skilled in the art from the above equations that the retention force in the interference fit between the extension tube and a bore is proportional to both the contact area A between the extension tube and the bore as well as interface pressure P created between the extension tube and a bore. The present invention provides a greater interference fit and therefore a greater interface pressure P between the extension tube and a bore than the prior art aerosol buttons 28A and 28B shown in FIGS. 4 and 5. The present invention also provides a greater contact area A between the extension tube and the bore than the prior art aerosol button 28B shown in FIG. 5.

Retention tests were performed to determine the retention force of the improved bore of the present invention. The retention force of the improved bore can be determined by measuring the force at which the extension tube is released by the improved bore when the internal channel of the extension tube is blocked. In these experiments, the aerosol button defining the improved bore was made from a nylon material whereas the extension tube was made from a polypropylene material. The theoretical retentions obtained by using equation 3 are set forth in Tables 1A–1F and 2A–2F.

TABLE 1A

| Three Holes Profile-top | Tolerance |
|---|---|
| D1 (bore ID, 2*$h_b$) 0.0835 +/− | 0.0005 |
| D2 (tube OD, 2*$b_t$) 0.0855 +/− | 0.0005 |
| D3 (tube ID, 2*a) 0.025 +/− | 0.002 |
| D4 (bore OD, 2*c) 0.272 +/− | 0.005 |
| D5 (con. length, 1) 0.031 +/− | 0.005 |

TABLE 1B

| Results: Three Holes Profile-top | | |
|---|---|---|
| Type of Fit | Interference fit "d" (inches) | Force "f" (pounds) |
| Min. | 0.0005 | 0.235 |
| Nom. | 0.0010 | 0.481 |
| Max. | 0.0015 | 0.738 |

TABLE 1C

| Three Holes Profile-Middle | Tolerance |
|---|---|
| D1 (bore ID, 2*$b_b$) 0.0820 +/− | 0.0005 |
| D2 (tube OD, 2*$b_t$) 0.0845 +/− | 0.0005 |
| D3 (tube ID, 2*a) 0.025 +/− | 0.002 |
| D4 (bore OD, 2*c) 0.272 +/− | 0.005 |
| D5 (con. length, 1) 0.032 +/− | 0.005 |

TABLE 1D

| Results: Three Holes Profile-Middle | | |
|---|---|---|
| Type of Fit | Interference fit "d" (inches) | Force "f" (pounds) |
| Min. | 0.0008 | 0.363 |
| Nom. | 0.0013 | 0.620 |
| Max. | 0.0018 | 0.888 |

TABLE 1E

| Three Holes Profile-Bottom | Tolerance |
|---|---|
| D1 (bore ID, 2*$b_b$) 0.0805 +/− | 0.0005 |
| D2 (tube OD, 2*$b_t$) 0.0835 +/− | 0.0005 |
| D3 (tube ID, 2*a) 0.025 +/ − | 0.002 |
| D4 (bore OD, 2*c) 0.272 +/− | 0.005 |
| D5 (con. length, 1) 0.032 +/− | 0.005 |

TABLE 1F

| Results: Three Holes Profile-Bottom | | |
|---|---|---|
| Type of Fit | Interference fit "d" (inches) | Force "f" (pounds) |
| Min. | 0.0010 | 0.482 |
| Nom. | 0.0015 | 0.742 |
| Max. | 0.0020 | 1.014 |

TABLE 2A

| Three Holes Profile-Top | Tolerance |
|---|---|
| D1 (bore ID, 2*$b_b$) 0.0845 +/− | 0.001 |
| D2 (tube OD, 2*$b_t$) 0.0855 +/− | 0.0005 |
| D3 (tube ID, 2*a) 0.025 +/− | 0.002 |
| D4 (bore OD, 2*c) 0.272 +/− | 0.005 |
| D5 (con. length, 1) 0.031 +/− | 0.005 |

TABLE 2B

| Results: Three Holes Profile-Top | | |
|---|---|---|
| Type of Fit | Interference fit "d" (inches) | Force "f" (pounds) |
| Min. | .0003 | — |
| Nom. | 0.0005 | 0.241 |
| Max. | 0.0013 | 0.617 |

TABLE 2C

| Results: Three Holes Profile-Middle | |
|---|---|
| | Tolerance |
| D1 (bore ID, 2*$b_b$) 0.0825 +/− | 0.001 |
| D2 (tube OD, 2*$b_t$) 0.0845 +/− | 0.0005 |
| D3 (tube ID, 2*a) 0.025 +/− | 0.002 |
| D4 (bore OD, 2*c) 0.272 +/− | 0.005 |
| D5 (con. length, 1) 0.032 +/− | 0.005 |

TABLE 2D

| Results: Three Holes Profile-Middle | | |
|---|---|---|
| Type of Fit | Interference fit "d" (inches) | Force "f" (pounds) |
| Min. | 0.0003 | 0.121 |
| Nom. | 0.0010 | 0.496 |
| Max. | 0.0018 | 0.891 |

TABLE 2E

| Three Holes Profile-Bottom | |
|---|---|
| | Tolerance |
| D1 (bore ID, 2*$b_b$)0.08 +/− | 0.001 |
| D2 (tube OD, 2*$b_t$) 0.0835 +/− | 0.0005 |
| D3 (tube ID, 2*a) 0.025 +/− | 0.002 |
| D4 (bore OD, 2*c) 0.272 +/− | 0.005 |
| D5 (con. length, 1) 0.032 +/− | 0.005 |

TABLE 7F

| Results: Three Holes Profile--Bottom | | |
|---|---|---|
| Type of Fit | Interference fit "d" (inches) | Force "f" (pounds) |
| Min. | 0.0010 | 0.481 |
| Nom. | 0.0018 | 0.866 |
| Max. | 0.0025 | 1.270 |

Preferably, the radial interferences between the between the extension tube and the bore should be less than or equal to 0.0015 inch at the opening to facilitate insertion of the extension tube into the bore for the consumer. In addition, the minimum retention force should be selected to be equal or greater than 0.5 pounds. This retention force may be properly established by selecting the radial interferences between the extension tube and the bore as well as the area of contact or the contact length between the extension tube and the bore.

The present disclosure comprises the forgoing specification and drawings and the appended claims. Although this invention has been described in the preferred form with a certain degree of particularity, it should be understood that the present disclosure of the preferred form has been made only by way of example and that numerous changes in the details of construction and the combination and arrangement of parts may be resorted to without departing from the spirit and scope of the invention as hereinafter claimed.

What is claimed is:

1. An improved mounting for a flexible extension tube in a fluid sprinkling apparatus for spraying a liquid from a container through the extension tube, the fluid sprinkling apparatus having an input orifice communicating with the liquid internal the container and an actuator means for controlling the flow of the liquid from the input orifice to a terminal orifice, the extension tube having an outer diameter, the improvement comprising:

a bore formed within the fluid sprinkling apparatus with said bore extending between an outer wall of the fluid sprinkling apparatus and an inner wall in the fluid sprinkling apparatus;

the terminal orifice being disposed within said inner wall of said bore;

said bore having a plurality of shoulders spaced along said bore from said outer wall to said inner wall for respectively defining a plurality of bore portions;

said plurality of bore portions having progressively decreasing diameters from said outer wall to said inner wall; and at least one of said bore portions radially inwardly compressing the flexible extension tube for frictionally retaining and forming a fluid tight seal with the extension tube irrespective of manufacturing tolerances of said bore and the outer diameter of the extension tube for enabling the liquid from the container to flow from the terminal orifice through the extension tube and to be expelled therefrom.

2. An improved mounting for an extension tube as set forth in claim 1, wherein said fluid sprinkling head comprises an aerosol valve having a dip tube for defining said input orifice.

3. An improved mounting for an extension tube as set forth in claim 1, including said fluid sprinkling head comprises a pump having a dip tube for defining said input orifice.

4. An improved mounting for an extension tube as set forth in claim 1, including a chamfer interposed between said outer wall and said first of said bore portions for facilitating insertion of the extension tube into said first of said bore portions.

5. An improved mounting for an extension tube as set forth in claim 1, wherein at least one of said bore portions forms an interference fit with the outer diameter of the extension tube.

6. An improved mounting for an extension tube as set forth in claim 1, wherein said bore portion located adjacent said outer wall is less in diameter than a maximum outer diameter of the extension tube including manufacturing tolerances of the extension tube.

7. An improved mounting for an extension tube as set forth in claim 1, wherein said bore portion located adjacent said inner wall is less in diameter than the minimum outer diameter of the extension tube including manufacturing tolerances of the extension tube.

8. An improved fluid sprinkling apparatus for spraying a liquid internal a container through a flexible extension tube, the extension tube having an outer diameter, comprising in combination:

a fluid sprinkling head communicating with an input orifice and a terminal orifice;

means for securing said fluid sprinkling head to the container with said input orifice communicating with the liquid internal the container;

means for providing a pressure for forcing the liquid within the container into said input orifice;

actuator means for controlling the flow of the liquid from said input orifice to said terminal orifice;

a bore defined in said fluid sprinkling head extending from an outer body wall of said fluid sprinkling head and terminating in an inner body wall in said fluid sprinkling head;

said terminal orifice being disposed within said inner body wall of said bore;

said bore having a plurality of shoulders spaced along said bore between said outer body wall and said inner body wall for respectively defining a plurality of bore portions;

said plurality of bore portions having progressively decreasing diameters from said outer body wall to said inner body wall; and at least one of said bore portions radially inwardly compressing the flexible extension tube for frictionally retaining and forming a fluid tight seal with the extension tube irrespective of manufacturing tolerances of said bore and the outer diameter of the extension tube for enabling the liquid from the pressurized container to flow from the terminal orifice through the extension tube and to be expelled therefrom.

9. An improved fluid sprinkling apparatus as set forth in claim 8, wherein said fluid sprinkling head comprises an aerosol valve having a dip tube for defining said input orifice.

10. An improved fluid sprinkling apparatus as set forth in claim 8, including said fluid sprinkling head comprises a pump having a dip tube for defining said input orifice.

11. An improved fluid sprinkling apparatus as set forth in claim 8, including a chamfer interposed between said outer wall and said first of said bore portions for facilitating insertion of the extension tube into said first of said bore portions.

12. An improved aerosol button for an aerosol spraying apparatus for spraying a liquid from a container through a flexible extension tube, the extension tube having an outer diameter, comprising in combination:

an aerosol valve assembly secured to the container;

said aerosol valve assembly having a dip tube for defining an input orifice communicating with the liquid internal the container;

said aerosol valve assembly further comprising a button actuator having a terminal orifice;

said button actuator controlling the flow of the liquid from said input orifice to said terminal orifice;

a bore defined in said button actuator extending from an outer button wall of said button actuator and terminating in an inner button wall in said button actuator;

said terminal orifice being disposed within said inner button wall of said bore;

said bore having a plurality of shoulders spaced along said bore from said outer button wall to said inner button wall for respectively defining a plurality of bore portions;

a first of said bore portions located adjacent said outer button wall being greater in diameter than the outer diameter of the extension tube for enabling insertion of an end of the extension tube into said first of said bore portions of said bore;

said plurality of bore portions having progressively decreasing diameters from said outer button wall to said inner button wall; and at least one of said bore portions radially inwardly compressing the flexible extension tube for frictionally retaining and forming a fluid tight seal with the extension tube irrespective of manufacturing tolerances of said bore and the outer diameter of the extension tube for enabling the liquid from the pressurized container to flow from the terminal orifice through the extension tube and to be expelled therefrom.

13. An improved mounting for an extension tube as set forth in claim 12, including a chamfer interposed between said outer button wall and said first of said bore portions for facilitating insertion of the extension tube into said first of said bore portions.

14. An improved mounting for an extension tube as set forth in claim 12, wherein said bore portion located adjacent said outer wall is less in diameter than a maximum outer diameter of the extension tube including manufacturing tolerances of the extension tube.

15. An improved mounting for an extension tube as set forth in claim 12, wherein said bore portion located adjacent said inner wall is less in diameter than the minimum outer diameter of the extension tube including manufacturing tolerances of the extension tube.

16. An improved mounting in a fluid sprinkling apparatus for receiving a flexible extension tube for spraying a liquid from a container through the extension tube, the extension tube having an outer diameter, comprising in combination:

a fluid sprinkling head having an input orifice and a terminal orifice;

means for securing said fluid sprinkling head to the container enabling said input orifice to communicate with the liquid internal the container;

actuator means for controlling the flow of the liquid from said input orifice to said terminal orifice;

a cylindrical bore defined in the fluid sprinkling apparatus extending along a cylindrical axis from an outer wall of said fluid sprinkling apparatus and terminating in an inner wall in the fluid sprinkling apparatus;

said terminal orifice being disposed within said inner wall and being positioned along said cylindrical axis of said cylindrical bore;

said cylindrical bore having a first shoulder defining a first bore portion;

a chamber interposed between said outer wall and said first bore portion for facilitating insertion of the extension tube into said first bore portion;

said cylindrical bore having a second shoulder defining a second bore portion extending between said first shoulder and said second shoulder;

said cylindrical bore defining a third bore portion extending between said second shoulder and said inner wall;

said first bore portion having a first inner diameter being less than the maximum outer diameter of the extension tube including manufacturing tolerances of the extension tube;

said second bore portion having a second inner diameter being less than the nominal outer diameter of the extension tube;

said third bore portion having a third inner diameter being less than the minimum outer diameter of the extension tube including manufacturing tolerances of the extension tube; and at least one of said bore portions radially inwardly compressing the flexible extension tube for frictionally retaining and forming a fluid tight seal with the extension tube irrespective of manufacturing tolerances of said bore of said fluid sprinkling head and irrespective of manufacturing tolerances of the outer diameter of the extension tube for enabling the liquid from the pressurized container to flow from the terminal orifice through the extension tube and to be expelled therefrom.

17. An improved mounting for an extension tube as set forth in claim 16, wherein said fluid sprinkling head comprises an aerosol valve having a dip tube for defining said input orifice.

18. An improved mounting for an extension tube as set forth in claim 16, including said fluid sprinkling head comprises a pump having a dip tube for defining said input orifice.

* * * * *